US008252073B2

(12) United States Patent
Tsang et al.

(10) Patent No.: US 8,252,073 B2
(45) Date of Patent: Aug. 28, 2012

(54) TAR-FREE GASIFICATION SYSTEM AND PROCESS

(75) Inventors: Albert C. Tsang, Sugar Land, TX (US); David L. Breton, Houston, TX (US)

(73) Assignee: Phillips 66 Company, Houston, TX (US)

( * ) Notice: Subject to any disclaimer, the term of this patent is extended or adjusted under 35 U.S.C. 154(b) by 0 days.

(21) Appl. No.: 12/635,244

(22) Filed: Dec. 10, 2009

(65) Prior Publication Data

US 2010/0155669 A1 Jun. 24, 2010

Related U.S. Application Data

(60) Provisional application No. 61/140,667, filed on Dec. 24, 2008.

(51) Int. Cl.

| | |
|---|---|
| ***B01J 8/00*** | (2006.01) |
| ***C01B 3/00*** | (2006.01) |
| ***C01B 3/02*** | (2006.01) |
| ***C07C 1/00*** | (2006.01) |
| ***C07C 1/02*** | (2006.01) |
| ***C10J 3/16*** | (2006.01) |
| ***C10J 3/46*** | (2006.01) |
| ***C10J 3/54*** | (2006.01) |

(52) U.S. Cl. ..... 48/202; 48/197 R; 48/206; 252/373; 422/600; 423/648.1

(58) Field of Classification Search ..... None
See application file for complete search history.

(56) References Cited

U.S. PATENT DOCUMENTS

| | | | | |
|---|---|---|---|---|
| 3,779,725 | A | 12/1973 | Hegarty et al. | |
| 3,782,913 | A * | 1/1974 | Donath | 48/202 |
| 4,209,304 | A | 6/1980 | Kessler | |
| 4,347,064 | A | 8/1982 | Reh et al. | |
| 4,531,949 | A | 7/1985 | Koyama et al. | |
| 4,872,886 | A * | 10/1989 | Henley et al. | 48/197 R |
| 5,433,760 | A * | 7/1995 | Doering et al. | 48/197 R |
| 6,141,796 | A | 11/2000 | Cummings | |
| 6,960,234 | B2 | 11/2005 | Hasset | |
| 2006/0076272 | A1 | 4/2006 | Stil | |
| 2006/0165582 | A1 | 7/2006 | Booker et al. | |
| 2007/0289216 | A1 | 12/2007 | Tsangaris et al. | |

FOREIGN PATENT DOCUMENTS

GB 2167431 5/1986

OTHER PUBLICATIONS

PCT/US2009/068066 International Search Report (Form PCT/ISA/220) dated Oct. 13, 2010.

* cited by examiner

*Primary Examiner* — Melvin C Mayes
*Assistant Examiner* — Colin W Slifka
(74) *Attorney, Agent, or Firm* — Phillips 66 Company

(57) ABSTRACT

A novel tar-free gasification process and system is disclosed that involves the partial combustion of recycled dry solids and the drying of a slurry feedstock comprising carbonaceous material in two separate reactor zones in a two stage gasifier, thereby producing mixture products comprising synthesis gas. The synthesis gas produced from the high temperature first stage reaction zone is then quenched in the second stage reaction zone of the gasifier prior to introduction of a slurry feedstock. The temperature of the final syngas exiting the second stage reaction zone of the gasifier is thereby moderated to be in the range of about 350-900° F., which is below the temperature range at which tar is readily formed, depending upon the type of carbonaceous feedstock utilized.

19 Claims, 1 Drawing Sheet

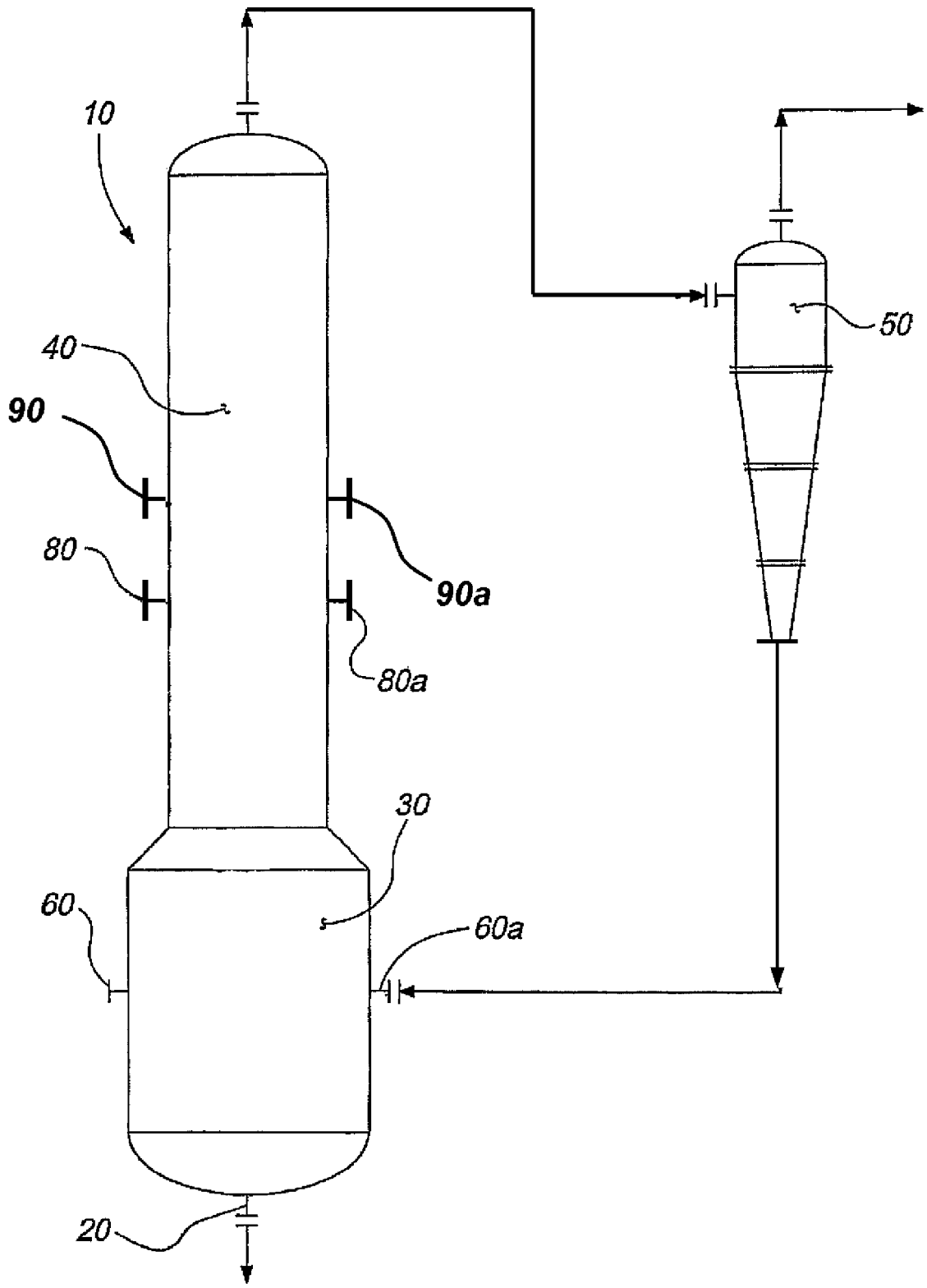
10
40
90
80
90a
80a
30
60
60a
20
50

TAR-FREE GASIFICATION SYSTEM AND PROCESS

BACKGROUND OF THE INVENTION

The present invention relates generally to a gasification system and process for converting generally solid feedstock such as carbonaceous material into desirable gaseous products such as synthesis gas. The gasification system and process must be designed to be simple, yet maximize carbon conversion efficiency.

Three basic types of system and processes have been developed for the gasification of carbonaceous materials. They are: (1) fixed-bed gasification, (2) fluidized-bed gasification, and (3) suspension or entrainment gasification. The present invention relates to the third type of system and process-suspension or entrainment gasification. More particularly, the present invention relates to a two stage entrained gasification system and process for gasifying carbonaceous materials.

The flexibility of the two stage gasifier design can be exploited by maximizing the slurry feed rate to the lower temperature second stage, thereby utilizing the heat generated in the first stage gasifier to evaporate water from the slurry. The char and unconverted carbon exiting the second stage gasifier are then separated and recycled back to the first stage gasifier in dry form, thus minimizing the amount of oxygen required in the higher temperature first stage and maximizing the conversion efficiency of the gasifier.

One problem with feeding to the lower temperature second stage is that the tar produced during the pyrolysis of the coal or petroleum coke is not adequately destroyed. The undestroyed tar condenses when the syngas is cooled, thereby fouling the heat exchange surfaces or plugging up the filters downstream. Technology is needed that allows increased feedstock addition to the lower temperature second stage of the gasification reactor, while minimizing the production of tar.

SUMMARY OF THE INVENTION

Historically, tar formation has been a major source of problem of heat exchange surface fouling and downstream filter plugging. The current inventive gasification process and system is significantly simpler, and less expensive to construct and maintain than previous systems, while simultaneously preventing the formation of tar.

Use of the system and process of the current invention maximizes the recovery of energy stored within the carbonaceous feedstock. The invention involves the partial combustion of recycled dry solids and the drying of carbonaceous slurry feedstock in two separate reactor zones of a two stage gasifier to thereby produce mixture products comprising synthesis gas. The syngas produced from the high temperature first stage reaction zone of the gasifier is then quenched in the second stage reaction zone into a low temperature syngas. A slurry feed stock is then introduced into the second stage to reduce the temperature of the final syngas exiting the second stage reaction zone of the gasifier. The temperature is reduced in order to be below that where tar formation occurs. This temperature is approximately 350-900° F., depending upon the type of feedstock utilized.

Certain embodiments of the present invention relate to a process for gasifying a carbonaceous material comprises the steps of a) introducing a dry feedstock into a reactor lower section and partially combusting therein with a gas stream comprising an oxygen-containing gas or steam thereby evolving heat and forming products comprising synthesis gas and molten slag; b) passing the synthesis gas from step a) upward into a reactor upper section, whereby the synthesis gas from step a) is cooled by one or more cooling agents; c) drying a slurry of particulate carbonaceous material in a liquid carrier with the cooled synthesis gas from step b) in the reactor upper section, thereby forming mixture products comprising a solid stream and a gaseous stream; d) passing the mixture products through a separating device whereby the solid stream is separated from the gaseous stream; and e) recycling the solid stream back to the reactor lower section. In such process, the hot synthesis gas produced in the reactor lower section is carried upward, thereby heating and/or vaporizing the cooling agent introduced in the second stage, such that the temperature of the mixture product formed in the second stage is reduced. Another aspect of the present invention relates to a system for gasifying a carbonaceous material comprising: a) a reactor lower section for partially combusting a dry feedstock with a gas stream comprising an oxygen-containing gas or steam to produce heat and products comprising synthesis gas and molten slag, wherein the reactor lower section comprises one or more dispersion devices for introducing the gas stream and the dry feedstock; b) a reactor upper section for cooling the synthesis gas from the reactor lower section followed by drying a slurry of particulate carbonaceous material in a liquid carrier with the cooled synthesis gas to produce mixture products comprising a solid stream and a gaseous stream; c) a separating device for separating the solid stream from the gaseous stream. In such system, the hot synthesis gas produced in the reactor lower section is carried upward, thereby heating and/or vaporizing the cooling agent introduced in the second stage, such that the temperature of the mixture product formed in the second stage is reduced.

In certain embodiments of the present invention, the temperature of reactor lower section is maintained in a range between 1500° F. and 3500° F., preferably in a range between 2000° F. and 3200° F. The pressure within the reactor lower section is maintained in a range between 14.7 psig and 2000 psig, but preferably in a range between 50 psig and 1500 psig. The temperature of the reactor upper section prior to the introduction of the slurry is maintained between 600° F. and 2000° F., but preferably between 800° F. and 1800° F. The pressure of the reactor upper section prior to the introduction of the slurry is maintained between 14.7 psig and 2000 psig, but preferably between 50 psig and 1500 psig. The temperature of the mixture products exiting reactor upper section and prior to entering the separation device is between 300° F. and 1200° F., but preferably between 350° F. and 900° F., and most preferably between 400° F. and 700° F. In certain embodiments of the present invention, the reactor upper section comprises one or more dispersion devices for introducing the slurry comprising particulate carbonaceous materials in the liquid carrier. The reactor upper section further comprises one or more feeding devices for introducing the cooling agent. The reactor lower section comprises one or more dispersion devices for introducing a gas stream comprising an oxygen-containing gas or steam.

In certain embodiments of the present invention, the cooling agent is introduced into the reactor upper section at a feeding rate in a range of 10 to 120 feet per second, preferably in a range of 15 to 100 feet per second, and most preferably in a range of 20 to 80 feet per second. The gas stream, comprising an oxygen-containing gas or steam, is introduced into the reactor lower section at a feeding rate in a range of 20 to 120 feet per second, but preferably in a range of 20 to 90 feet per second. The slurry comprising particulate carbonaceous materials in the liquid carrier is introduced into the reactor upper section at a feeding rate in a range of 10 to 80 feet per second.

In certain embodiments of the present invention, the carrier liquid may be water, liquid $CO_2$, petroleum liquid or any mixtures thereof. The particulate carbonaceous material may be coal, lignite, petroleum coke, or any mixtures thereof. The cooling agent according to embodiment of the current invention may be water or recycled syngas or any mixtures thereof. The oxygen-containing gas may be air, oxygen-enriched air, oxygen or any mixtures thereof.

In certain embodiments of the present invention, the slurry comprising particulate carbonaceous material has a solid concentration from 30 to 75 percent, but preferably from 45 to 70 percent by weight, based upon the total weight of the slurry.

BRIEF DESCRIPTION OF THE DRAWINGS

For a more detailed description of the embodiments of the present invention, reference will now be made to the accompanying drawings, wherein:

FIG. 1 is a schematic depiction of a gasification system and a pictorial process flow diagram representing one embodiment of the present invention.

DETAILED DESCRIPTION OF THE PREFERRED EMBODIMENT

The following detailed description of various embodiments of the invention makes reference to the accompanying FIGURE and illustrates a specific embodiment in which the invention can be practiced. This embodiment is intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Referring to FIG. 1, one embodiment of the present invention provides a gasification reactor, indicated generally by reference numeral 10, that comprises a reactor lower section 30 and a reactor upper section 40. The reactor lower section 30 defines the first stage reaction zone of the gasification process, while the reactor upper section 40 defines the second stage reaction zone of the gasification process.

Referring again to FIG. 1, the recycled char and a stream comprising an oxygen-containing gas and/or steam at high pressure are introduced into the gasification reactor 10 lower section 30 through dispersion device 60 and/or 60*a*. In certain embodiments, the dispersion devices are located on opposing sides of the reactor lower section 30. More than two dispersion devices can be used. For example, four devices may be used, and arranged 90 degrees apart. The dispersion devices can also be on different levels and need not be on the same plane.

Within the reactor lower section 30 (or first stage reaction zone) of the gasification reactor 10, the recycled char, and a stream comprising an oxygen-containing gas and/or steam react such that rapid mixing and reaction of the reactants occurs, thereby imparting a rotating motion, such that the combined reactants pass upwardly as (but not limited to) a vortex through the lower section 30 of the reactor 10. The reaction in the reactor lower section 30 is the first stage of the gasification process by which the recycled char, and a stream comprising an oxygen-containing gas and/or steam are converted exothermically into mixture products comprising steam, synthesis gas, intermediate gases, and entrained by-products such as molten slag, as disclosed later in more detail. The molten slag thus formed drains from the bottom of the reactor 10 through a tap hole 20, to a slag processing system (not shown) for final disposal.

The steam, intermediate, and synthesis gas exit from reactor lower section 30 by flowing upward into an unfired reactor upper section 40, where a cooling agent such as (but not limited to) water and/or cold syngas recycled from the downstream system are injected through feeding devices 80 and/or 80*a*, or additional feeding devices. The heat produced in the reactor lower section 30 and carried upward with gas stream is utilized in heating the water and/or cold syngas, thereby lowering the temperature of the resultant mixture. This cooling step may also be accomplished by any direct heat exchange method that is conventionally known to those skilled in art.

After the steam, intermediate, and synthesis gas exit from reactor lower section 30 by the above cooling step, a slurry of particulate carbonaceous solids in a liquid carrier are injected through feeding device 90 and/or 90*a*, or additional feeding devices. A drying and reaction process then takes place in the unfired reactor upper section 40, including vaporization of the feed water, the carbon-steam reaction and the water-gas reaction between the CO and $H_2O$ to produce $H_2$ (which is preferred versus CO when $CO_2$ sequestration to reduce $CO_2$ emissions is desired).

While the fired reactor lower section 30 (or the first stage reaction zone of the reactor 10) is primarily a combustion reactor, the reactor upper section 40 is primarily a quench reactor and a drying chamber for the slurry. Hot gases rising from the reactor lower section 30 are cooled by the addition of feedstock slurry. This, combined with the fact that the overall reactions occurring in unfired reactor upper section 40 are endothermic results in a cooling of the gases to the point that entrained ash is cooled below the ash fusion initial deformation temperature. Volatile organic and inorganic species then condense and either agglomerate to themselves or are absorbed onto particulate carbonaceous material prior to reaching the heat transfer surfaces, and therefore do not adhere to these surfaces. The reaction conditions in the reactor upper section 40 is disclosed in more detail below.

In the embodiment of the present invention shown in FIG. 1, the unfired reactor upper section 40 of the reactor 10 is connected directly to the top of the fired reactor lower section 30 of the reactor 10 such that the hot reaction products are conveyed directly from the reactor lower section 30 to the reactor upper section 40. This configuration minimizes heat losses in the gaseous reaction products and entrained solids.

As illustrated in FIG. 1, the char produced by the gasification reaction may be separated from the raw syngas stream, and recycled to increase carbon conversion. For example, char may be recycled to the reactor lower section through dispersion devices 60 and/or 60*a* (or others) as discussed above. In certain embodiments, the dispersion devices 60 and 60*a* provide a dispersed feed of the particulate solids such as char into the first stage of the reactor. The dispersion devices may be, for example, a device having a central tube for the solids and an annular space surrounding the central tube for addition of an atomizing gas which opens to a common mixing zone internally or externally. Further, the feeding devices 80 and/or 80*a*, and 90 and/or 90*a*, of the unfired reactor upper section 40 may also be similar to the dispersion devices described hereinabove, or simply comprise a tube for slurry or quench media feeding. Dispersion devices 60, 60*a*, quenching devices 80, 80*a*, and feeding devices 90, 90*a* may be constructed as is commonly known to those skilled in the art.

As further shown in FIG. 1, the mixture products of the second stage reaction produced in the reactor upper section 40 are withdrawn from the top of the upper section 40 of the reactor and introduced into a separating device 50 that splits the combined stream into a solid stream and gas stream. The solids stream exiting separating device 50 comprises solidified ash, char and dried carbonaceous solid particles formed in the unfired reactor upper section reactor 40. This solids stream is mixed with oxygen-containing gas and/or steam and recycled back to the fired reactor lower section 30 through dispersion devices 60 and/or 60*a* as feed stock for first stage reaction.

The gas stream exiting from separating device 50 comprises hydrogen, carbon monoxide, a small amount of methane, hydrogen sulfide, ammonia, nitrogen, carbon dioxide and small fraction of residual solid fines. The gas stream may be further introduced into a particulate filtering device (not shown) whereby the residual solid fines and particulates are removed. Once the particulates are removed, the syngas produced is tar-free and can be further processed in a warm gas desulfurization unit without additional treatment for the removal of tar. The lower syngas temperature exiting the gasifier also eliminates the need for a high temperature heat recovery boiler, which simplifies the overall gasification system and process with much improved reliability and lowered capital, operating and material cost.

The materials of construction of the gasification reactor 10 are not critical. Preferably, but not necessarily, the reactor walls are steel and are lined with an insulating castable or ceramic fiber or refractory brick, such as a high chromium-containing brick in the reactor lower section 30 and a dense medium, such as used in blast furnaces and non-slagging applications in the reactor upper section 40, in order to reduce heat loss and to protect the vessel from high temperature and corrosion slag, as well as to provide for better temperature control. These materials are all commercially available. Alternatively, the walls may be unlined by providing a "cold wall" system for fired reactor lower section 30 and, optionally, unfired upper section 40. The term "cold wall", refers to a method for cooling the walls of the reactor using a cooling jacket with a circulated cooling medium, as is known conventionally in the art for coal gasification systems. In such systems, slag freezes on the cooled wall and thereby protects the metal walls of the cooling jacket.

The physical conditions of the first stage reaction in the reactor lower section 30 are controlled and maintained to assure rapid gasification of the recycled char. More specifically, the temperature of fired reactor lower section 30 is maintained from 1500° F. to 3500° F., but preferably from 2000° F. to 3200° F. and most preferably from 2400° F. to 3000° F. At such temperatures, ash formed by the gasification of char therein melts to form molten slag having a slag viscosity not greater than approximately 250 poises, which drains through a tap hole at the bottom of the reactor and is further conditioned in units outside the scope of this document.

The physical conditions of the reaction in the second stage of the gasification process in the reactor upper section 40 are controlled to assure rapid gasification and heating of the feedstock above its range of plasticity. More specifically, the temperature within this section, as measured after introduction of the quenching medium but before the introduction of feedstock slurry, is maintained from 600° F. to 2000° F., but preferably from 800° F. to 1800° F. and most preferably from 1000° F. to 1600° F. The hot intermediate product flowing upward from fired reactor lower section 30 provides heat for the endothermic reactions occurring in the unfired upper reactor section 40.

The operation parameters of the cooling step (described above) are adjusted according to the type and concentration of particulate carbonaceous feedstock in the carrier liquid. More specifically, the temperature at which the cooling process is operated is adjusted such that the final temperature of mixture products emanating from the second stage is between 300 and 1200° F., but preferably between 350 and 900° F., and most preferably between 400° F. and 600° F. Within this temperature range, heavy molecular-weight tar species are typically not emitted. As a result, the syngas exiting the separating device 50 and optional particulate filtering device will be tar free and particulate-free, and can be easily processed further by the conventional purification process including acid gas removal, sulfur recovery, etc.

The process of this invention is carried out at atmospheric or higher pressures. Generally, the pressure within the reactor lower section 30 and upper section 40 is maintained from 14.7 psig to 2000 psig, but preferably from 50 psig to 1500 psig, and most preferably from 150 psig to 1200 psig.

In the various embodiments of the present invention, the velocity (or feed rate) of gases and solids passing through the dispersion devices 60 and/or 60*a* of the reactor lower section reactor 30 is kept between 20 and 120 feet per second, but preferably between 20 and 90 feet per second, and most preferably between 30 and 60 feet per second. The residence time of char in the reactor lower section 30 is kept between 2 seconds and 10 seconds and preferably between 4 seconds and 6 seconds. The velocity or the feed rate of the slurry stream passing through the feeding device 90 and/or 90*a* of the reactor upper section reactor 40 is kept between 5 feet per second and 100 feet per second, but preferably between 10 feet per second and 80 feet per second, and most preferably between 20 feet per second and 60 feet per second. The velocity (or feed rate) of the water or cold synthesis gas recycled from the downstream system passing through the feeding device 80 and/or 80*a* of the reactor upper section reactor 40 is kept between 10 feet per second and 120 feet per second, but preferably between 15 feet per second and 100 feet per second, and most preferably between 20 and 80 feet per second. The residence time in the reactor upper section 40 is maintained between 5 seconds and 40 seconds.

The process may be employed using any particulate carbonaceous feedstock material. However, the particulate carbonaceous material is preferably coal which, without limitation, includes lignite, bituminous coal, sub-bituminous coal, or any combination thereof. Additional carbonaceous materials that may be utilized are coke from coal, coal char, coal liquefaction residues, particulate carbon, petroleum coke, carbonaceous solids derived from oil shale, tar sands, pitch, biomass, concentrated sewer sludge, bits of garbage, rubber and any mixtures thereof. The foregoing exemplified materials can be in the form of comminuted solids, and for best materials handling and reaction characteristics, as pumpable slurries in a liquid carrier.

The liquid carrier for carbonaceous solid materials can be any liquid capable of vaporizing and participating in the reactions to form desired gaseous products, particularly carbon monoxide and hydrogen. Preferably, the liquid carrier is water, which forms steam in lower reactor section 30. The steam then reacts with carbonaceous feedstock to form gaseous products that are valuable constituents of synthesis gas. However, liquids other than water may be used to slurry the carbonaceous material, for example, fuel oil, residual oil, petroleum, and liquid $CO_2$. When the liquid carrier is a hydrocarbon, additional water or steam may be added to provide sufficient water for efficient reaction and for moderating the reactor temperature.

Any gas containing at least 20 percent oxygen may be used as the oxygen-containing gas fed to the fired reactor lower section 30. Preferred oxygen-containing gases include oxygen, air, and oxygen-enriched air.

The concentration of particulate carbonaceous material in the carrier liquid as a slurry is limited only by the need to have a pumpable mixture. In general, the concentration of carbonaceous material may range up to 80 percent by weight. Preferably, the concentration of particulate carbonaceous material in the slurry ranges from 30 percent to 75 percent by weight in both the first and second stages of the process. More preferably, the concentration of coal particles in an aqueous slurry is between 45 and 70 percent by weight.

When coal is the feedstock, it can be pulverized before being blended with a liquid carrier to form slurry, or ground together with the liquid media. In general, any reasonably finely-divided carbonaceous material may be used, and any of the known methods of reducing the particle size of particulate solids may be employed. Examples of such methods include the use of ball, rod and hammer mills. While particle size is not critical, finely divided carbon particles are preferred. Powdered coal used as fuel in coal-fed power plants is typical. Such coal has a particle size distribution in which 90 percent by weight of the coal passes through a 200 mesh sieve. A coarser size of 100 mesh average particle size can also be used for more reactive materials, provided stable and non-settling slurry can be prepared.

As used herein, the term "char" refers to unburned carbon and ash particles that remain entrained within a gasification system after production of the various products.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

The scope of protection is not limited by the description set out above, but is only limited by the claims that follow, that scope including all equivalents of the subject matter of the claims. Each and every claim is incorporated into the specification as an embodiment of the present invention. Thus, the claims are a further description and are an addition to the preferred embodiments of the present invention.

Any element in a claim that does not explicitly state "means for" performing a specified function, or "step for" performing a specific function, is not to be interpreted as a "means" or "step" clause as specified 35 U.S.C. §112 ¶ 6. In particular, the use of "step of" in the claims herein is not intended to invoke the provisions of 35 U.S.C. §112 ¶6.

What is claimed is:

1. A process for the gasification of a carbonaceous material, comprising the steps of:

a. introducing a dry feedstock into a reactor lower section and partially combusting therein with a gas stream comprising an oxygen-containing gas or steam to evolve heat and form products comprising hot synthesis gas and molten slag;

b. passing said synthesis gas from step a) upward into a reactor upper section and injecting at least one cooling agent into said reactor upper section, wherein said hot synthesis gas from step a) transfers heat to said at least one cooling agent, thereby producing a cooled synthesis gas;

c. introducing a slurry of particulate carbonaceous material in a liquid carrier into said reactor upper section downstream from the point of injecting the cooling agent of step b), and drying the slurry with said cooled synthesis gas from step b) in said reactor upper section to form mixture products comprising a dry solid stream and a gaseous stream, wherein said drying occurs at a temperature that prevents the formation of tar and is below the temperature at which tar is formed, thereby producing a tar-free gaseous stream, wherein the temperatire of said reactor upper section after step b) and prior to step c) is maintained between 600° F and 2000° F and at a pressure in a range of 14.7 psig to 2000 psig;

d. passing said mixture products through a separating device, wherein said dry solid stream is separated from said tar-free gaseous stream; and e. recycling said dry solid stream back to said reactor lower section, wherein said dry solid stream comprises ash, char, and dried carbonaceous solid particles formed in the unfired reactor upper section, and wherein said dry solid stream is used as dry feedstock for said reactor lower section.

2. The process of claim 1, wherein step a) is carried out at a temperature in a range of 1500° F. and 3500° F. and at a pressure in a range of 14.7 psig to 2000 psig.

3. The process of claim 1 wherein step a) is carried out at a temperature in a range of 2000° F. and 3200° F. and at a pressure in a range of 50 psig to 1500 psig.

4. The process of claim 1, wherein the temperature of said reactor upper section after step b) and prior to step c) is maintained between 800° F. and 1800° F. and at a pressure in a range of 50 psig to 1500 psig.

5. The process of claim 1, wherein said cooling agent is selected from a group consisting of water, recycled syngas, and any mixture thereof.

6. The process of claim 1, wherein said gas stream comprising an oxygen-containing gas or steam is introduced into said reactor lower section at a feeding rate in a range of 20 to 120 feet per second, and wherein the residence time of said dry feedstock in said reactor lower section is in a range of 2 to 10 seconds.

7. The process of claim 1, wherein said gas stream comprising an oxygen-containing gas or steam is introduced into said reactor lower section at a feeding rate in a range of 20 to 90 feet per second, and wherein the residence time of said dry feedstock in said reactor lower section is in a range of 4 to 6 seconds.

8. The process of claim 1, wherein said slurry comprising particulate carbonaceous material in said liquid carrier is introduced into said reactor upper section at a feeding rate in a range of 10 to 80 feet per second, and wherein the residence time of said slurry in said reactor upper section is in a range of 5 to 40 seconds.

9. The process of claim 1, wherein said cooling agent is introduced into said reactor upper section at a feeding rate in a range of 10 to 120 feet per second.

10. The process of claim 1, wherein said liquid carrier is selected from group consisting of water, liquid $CO_2$, petroleum liquid and any mixtures thereof.

11. The process of claim 1, wherein said particulate carbonaceous material is selected from group consisting of coal, lignite, petroleum coke and any mixtures thereof.

12. The process of claim 1, wherein said slurry comprising particulate carbonaceous material has a solids concentration from 30 to 75 percent by weight based upon the total weight of said slurry.

13. The process of claim 1, wherein said slurry comprising particulate carbonaceous material has a solids concentration from 45 to 70 percent by weight based upon the total weight of said slurry.

14. The process of claim 1, wherein said oxygen-containing gas is selected from a group consisting of air, oxygen-enriched air, oxygen and any mixtures thereof.

15. The process of claim 1, further comprising a step of passing said gaseous product stream through a particulate filtering device, whereby residual solid fines and particulates are separated from said gaseous product stream.

16. The process of claim 1, wherein the temperature of said mixture products exiting reactor upper section, prior to entering said separation device, is between 300° F. and 1200° F.

17. The process of claim 1, wherein the temperature of said mixture products exiting reactor upper section, prior to entering said separation device, is between 400° F. and 600° F.

18. The process of claim 1, wherein said dry feedstock comprises recycled char, ash, and dried carbonaceous solid particles.

19. The process of claim 1, wherein said solid stream comprises recycled char, ash, and dried carbonaceous solid particles, and wherein said gaseous stream comprises synthesis gas and molten slag.

* * * * *

UNITED STATES PATENT AND TRADEMARK OFFICE

CERTIFICATE OF CORRECTION

PATENT NO. : 8,252,073 B2
APPLICATION NO. : 12/635244
DATED : August 28, 2012
INVENTOR(S) : Albert C. Tsang et al.

It is certified that error appears in the above-identified patent and that said Letters Patent is hereby corrected as shown below:

In the Claims:

At column 8, claim number 1, line number 13, "wherein the temperatire" should read --wherein the temperature--.

Signed and Sealed this
Twenty-sixth Day of May, 2015

Michelle K. Lee

Michelle K. Lee
*Director of the United States Patent and Trademark Office*